US007040979B1

(12) United States Patent
Betz

(10) Patent No.: US 7,040,979 B1
(45) Date of Patent: May 9, 2006

(54) MULTI-SEASON CRAWL SPACE VENT

(75) Inventor: Richard L. Betz, Houghton Lake, MI (US)

(73) Assignee: Ultra Creative Concepts, LLC, Houghton Lake, MI (US)

( * ) Notice: Subject to any disclaimer, the term of this patent is extended or adjusted under 35 U.S.C. 154(b) by 0 days.

(21) Appl. No.: 10/988,933

(22) Filed: Nov. 15, 2004

Related U.S. Application Data

(63) Continuation of application No. 10/679,894, filed on Oct. 6, 2003, now Pat. No. 6,817,942.

(51) Int. Cl.
*F24F 7/00* (2006.01)

(52) U.S. Cl. ..... 454/271

(58) Field of Classification Search ..... 454/129, 454/270–283; 296/218
See application file for complete search history.

(56) References Cited

U.S. PATENT DOCUMENTS 3,974,753 A * 8/1976 Blomgren et al. ..... 296/218

* cited by examiner

*Primary Examiner*—Harold Joyce
(74) *Attorney, Agent, or Firm*—Northern Michigan Patent Law, PLC

(57) ABSTRACT

A vent assembly for a crawl space type vent opening in the foundation wall of a building has a front frame engaging the outer face of the wall around the opening, swappable venting plates for the front frame, and a rear frame engaging the inner face of the wall in the crawl space and connected under tension through the opening to the front frame. A first form of the vent can be installed axially into the vent opening from the outside of the building to replace an existing vent in a finished wall. A second form of the vent is installed vertically into the vent opening in the wall before the opening has been capped, as part of new construction.

10 Claims, 13 Drawing Sheets

FIG - 2B
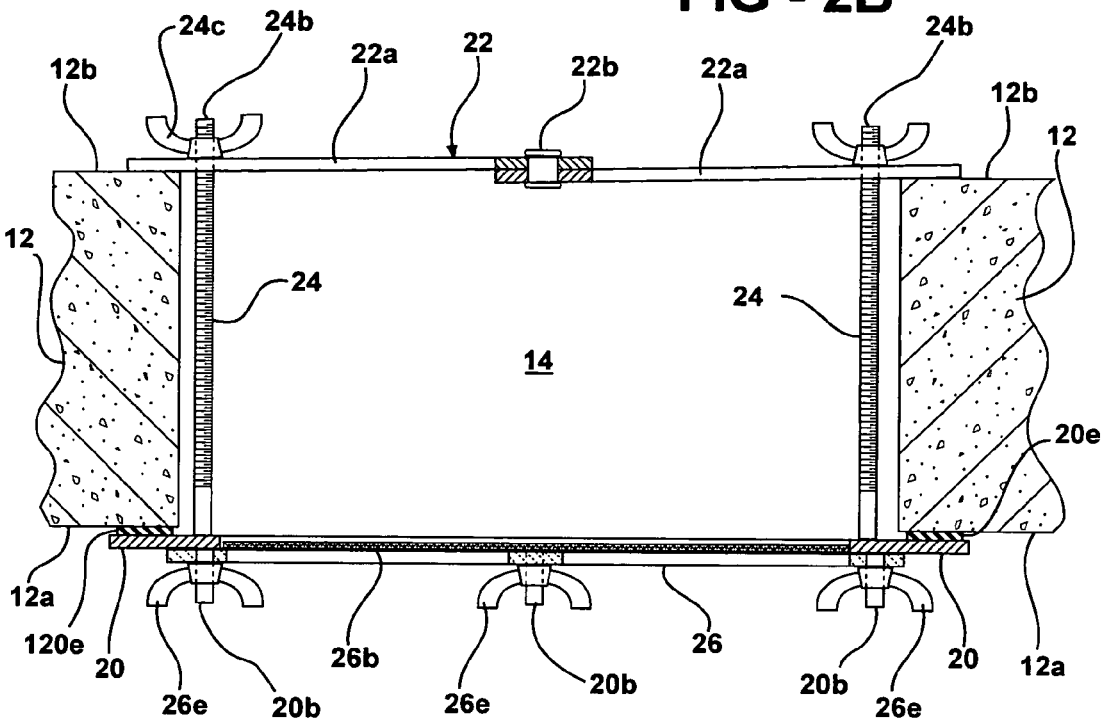
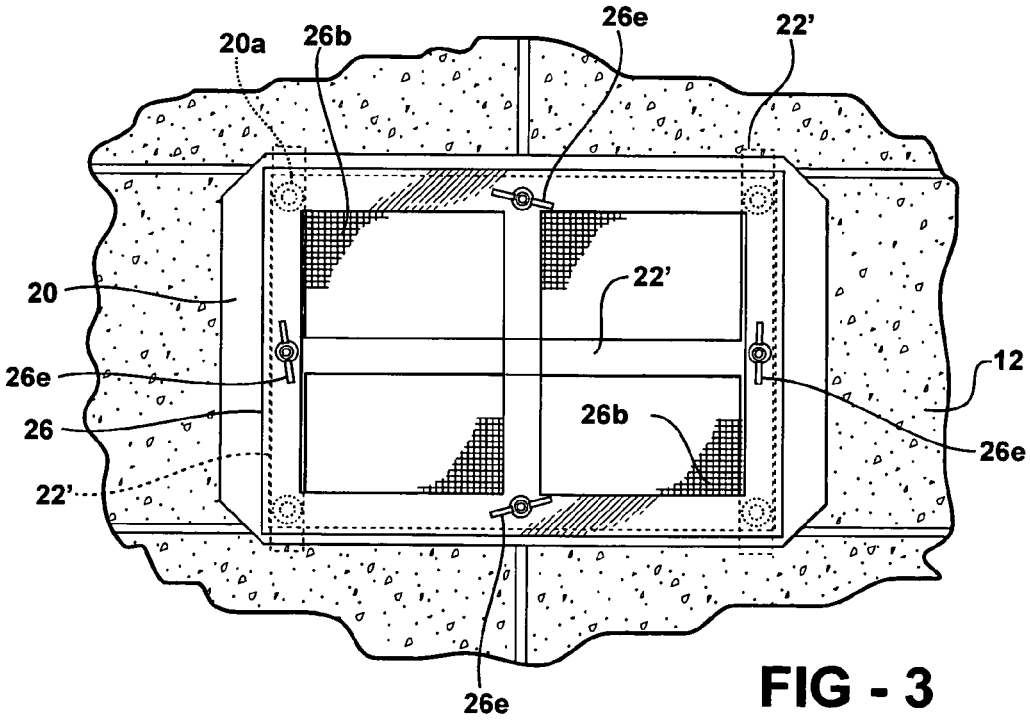
FIG - 3

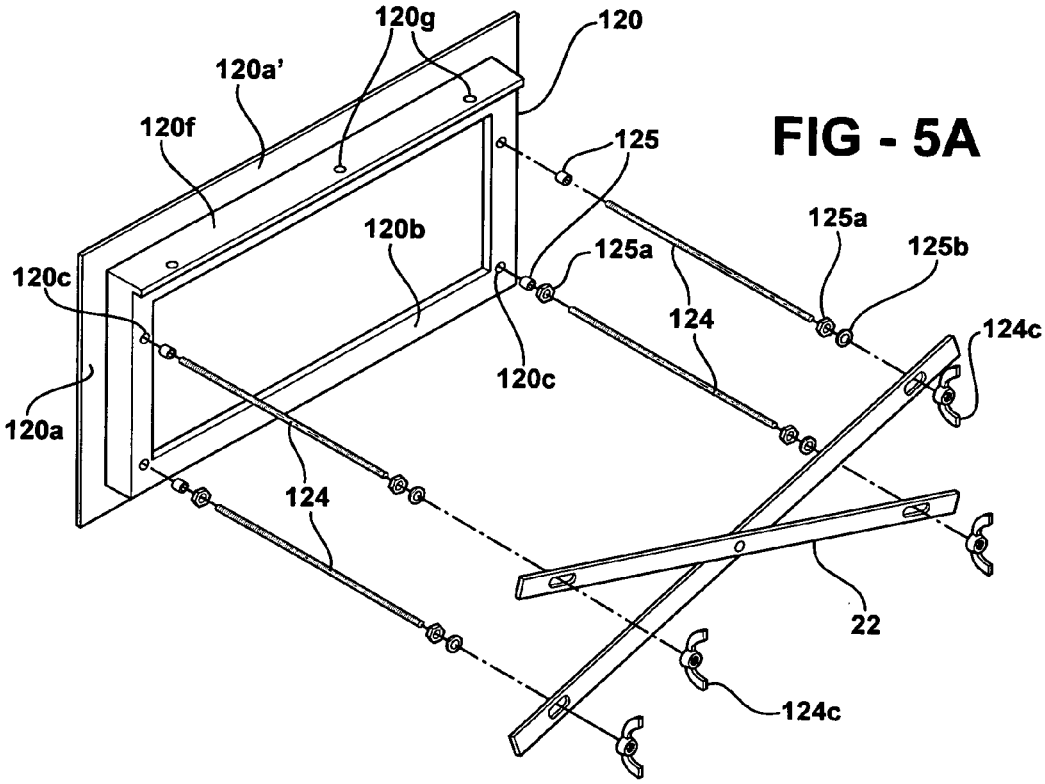
FIG - 5A
FIG - 6
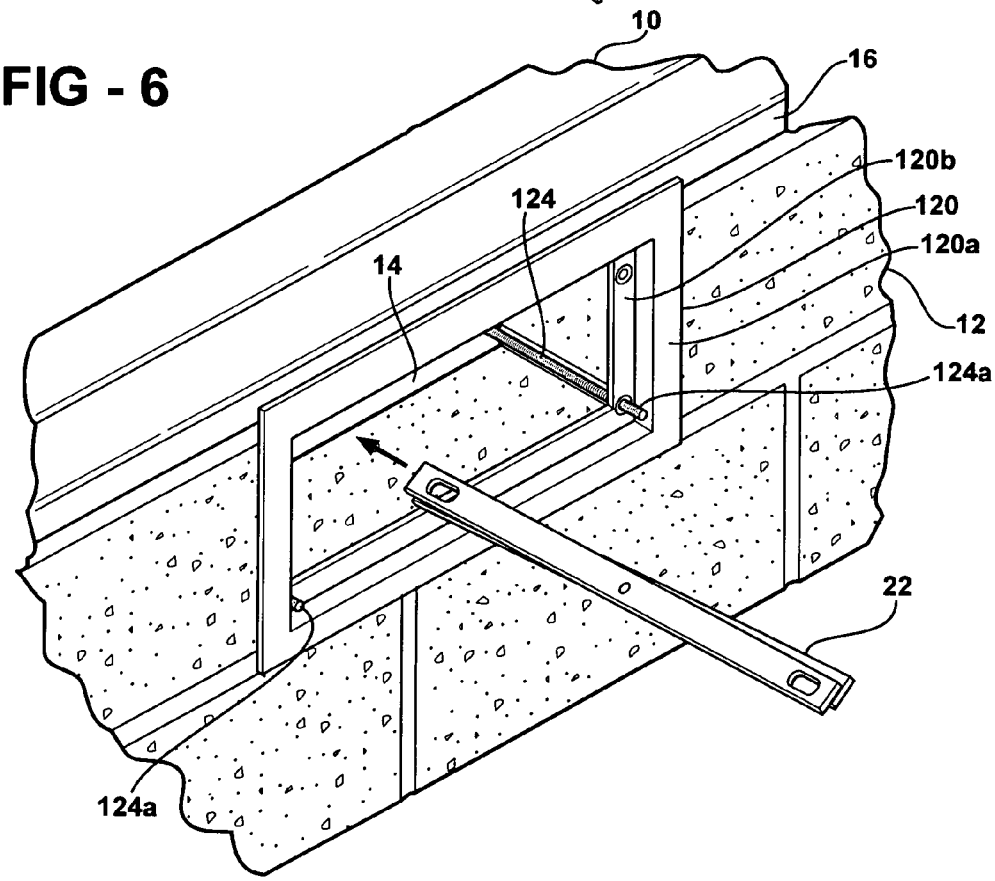

FIG - 7
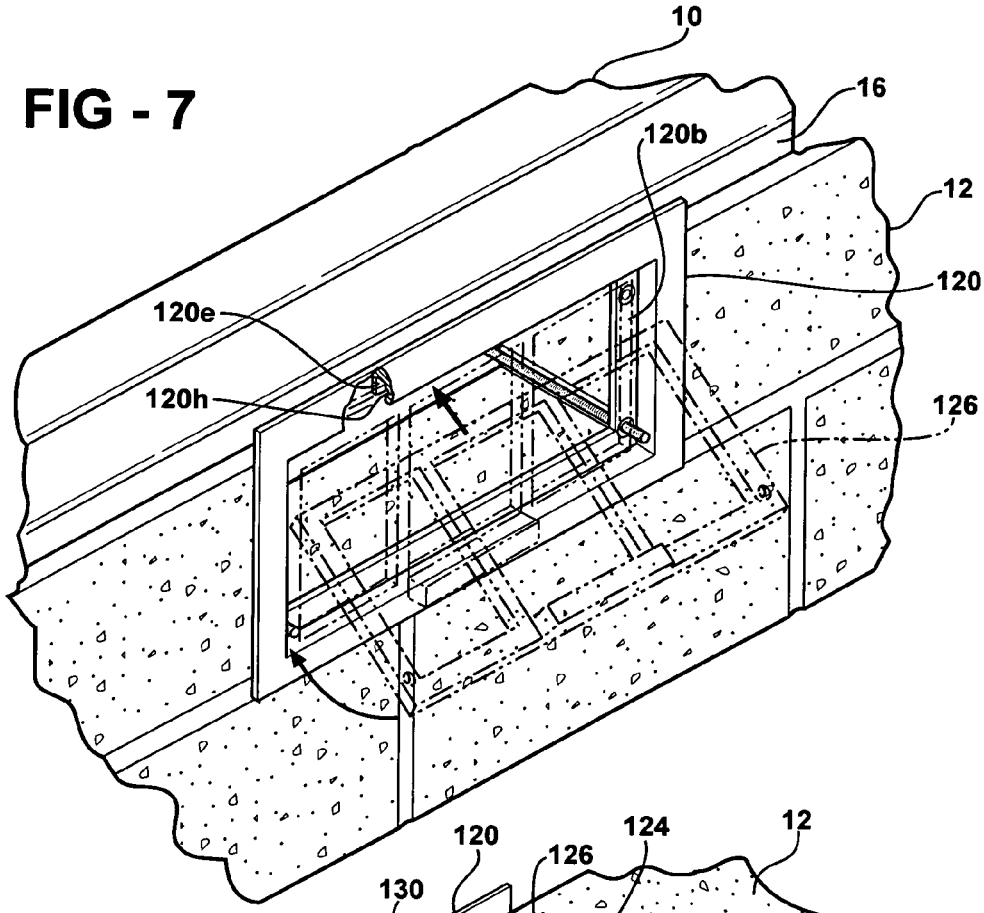
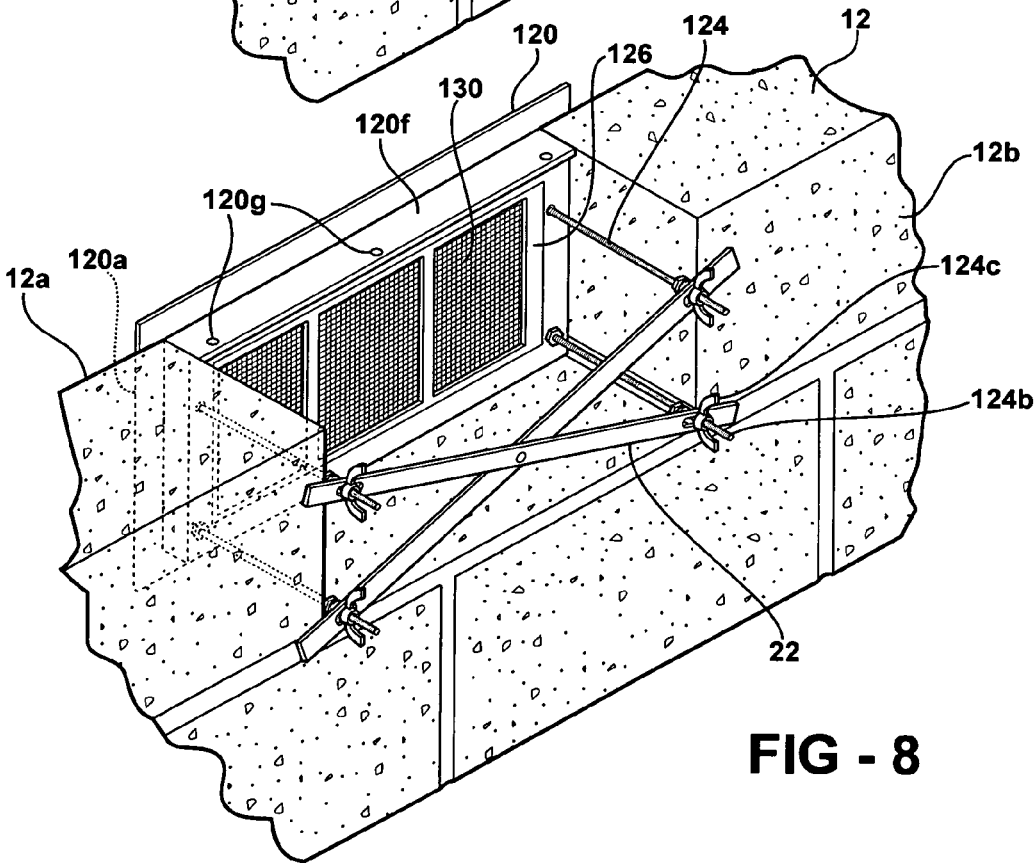
FIG - 8

MULTI-SEASON CRAWL SPACE VENT

This application is a continuation of application Ser. No. 10/679,894, now U.S. Pat. No. 6,817,942, filed Oct. 6, 2003, issued Nov. 16, 2004.

FIELD OF THE INVENTION

The present invention is in the field of vents built into the foundation walls of buildings with crawl spaces and the like that need passive venting.

BACKGROUND OF THE INVENTION

Houses and buildings with crawl space type spaces are typically provided with vents in the exposed foundation wall around the crawl space to prevent moisture build-up and damage. These crawl space or "foundation" vents are cemented or otherwise permanently secured in openings left in the block or cement wall at the time of construction, the openings in the wall providing for a flow of air to and from the crawl space. The vents typically have a grille and/or screen or mesh face to keep rodents and insects out, and often have closeable louvers or dampers to seasonally adjust airflow in colder climates.

Theoretically, the closeable-type vents are left open in warmer weather to keep the crawl space vented and dry, and in colder climates closed for the fall/winter to keep the crawl space (and the floor of the house) warm. However, the adjustment mechanisms in these vents are often relatively complex and prone to damage or failure through abuse such as being painted over, banged with lawn equipment, and exposed to the elements. The vents can accordingly become difficult to adjust properly and can even get stuck in one position. Over time the damage and wear accumulate, making the original unattractive and ripe for replacement. However, calling a contractor in for the relatively minor but time-consuming task of replacing one or more original, cemented-in vents can be inordinately expensive.

Since the vents are cemented or otherwise permanently secured in the foundation wall around the perimeter of the crawl space (often a considerable distance from the crawl space access in the house or building), it can be a cold, dirty crawl to try to repair, close, seal, and sometimes even insulate the vents from the inside. Accordingly, one can often see plastic sheeting, insulation boards and hay bales mounted and piled at unsightly intervals around the foundations of houses with crawl spaces in colder climates as homeowners try to slow down the wasteful, expensive, and uncomfortable heat loss from their homes via the crawl space vents, and to reduce the corresponding potential for frozen pipes. U.S. Pat. No. 6,149,514 attempts to partially solve the problem with a cut-to-size, snap-on, insulated cover, with snap-fittings secured to the foundation wall around the cemented-in vent to receive the insulated cover.

Another disadvantage of conventional closeable crawl space vents is the relatively limited ventilation area they offer for a given size when maximum venting is desired, since the louvers and associated support and adjustment structure reduce the net venting area of the screen or mesh and obstruct airflow.

BRIEF SUMMARY OF THE INVENTION

The present invention is a crawl space vent assembly that can be opened in warmer weather for nearly unrestricted venting, partially restricted for reduced venting in cooler weather, or even sealed tightly and/or insulated in the coldest weather or where pipes run near a vent opening, all from the outside of the house. In a first and preferred embodiment the vent assembly is designed to be retrofit to an existing crawl space vent opening after removing the original conventional vent. The retrofit embodiment also lends itself to drop-in installation for new construction. The vent is damage-resistant and easily adjusted and repaired.

In a second embodiment the vent is specifically designed for drop-in installation in a new foundation wall during construction.

In general, the vent assembly has a front frame adapted to engage the face of the foundation wall around the front of the vent opening; a set of swappable venting plates easily installed on and removed from the front frame member from the exterior of the house for different levels of venting; a screen associated with the venting plates; and a rear frame connectable to the front frame through the opening under tension to secure the vent assembly solidly to the front and rear faces of the foundation wall. The rear frame preferably includes a cross-member spanning the opening, able to retain an optional volume of insulation added to the vent through the front frame, minimizing airflow obstruction when insulation is not present, and providing an aligned-with-the-opening handgrip for an installer working from the outside to position the rear frame relative to the tension member(s) in the crawl space. If more than one cross-member is used, space is provided between the members for an outside installer to insert a hand through the rear frame.

In the preferred form the front and rear frames are adjustably connected to one another to be pre-positioned in the opening and then tensioned against the outside and inside faces of the wall around the vent opening. The adjustable frames can be made sufficiently adjustable to accommodate variations in wall thickness.

In the preferred, retrofit embodiment of the invention, the vent assembly has a collapsible rear frame designed to be inserted through the pre-positioned front frame and vent opening from the outside and opened up inside to engage one or more adjustable tension members extending from the front frame. The rear frame is then tensioned against the wall using the tension members connected to the front frame. In a most preferred form of this embodiment, the rear frame is a pair of pivoting members, sized to be inserted through the wall opening when folded and then opened to span the opening and engage the inside wall around the opening. The assembly is sufficiently rigid on its own that it can even be installed in drop-in fashion in new construction.

The second, drop-in embodiment of the vent is specifically designed for original installation in a new foundation wall, and includes an intermediate boxlike body connecting the front and rear frames. In a preferred version the body is adjustable to tension the front and rear frames against the inner and outer faces of the wall around the opening, and optionally to accommodate different wall thicknesses.

In a first form, the front frame receives the venting plate in axial, stack-on fashion. In a preferred form the front frame includes a venting plate receiver panel with an interlocking insertion fit that lends itself to aligning and holding the receiver in place for hands-free final securing. The receiver panel is easily removed from the front frame for repair, maintenance and/or replacement of interior components and venting plates. The preferred form of the receiver panel tilts open for a smooth release from the front frame, and includes a lateral slot for slidably receiving a venting plate from one end. The receiver panel also preferably includes a second lateral slot for slidably receiving a removable and replace-able screen member. The receiver panel supports and protects the venting plate and especially the screen from damage, but in the event they are damaged, they are each easily replaced.

Another feature of the invention is found in the venting plate vent openings, which are intended to overlie the screen and which have successively smaller, coaxial openings from plate to plate.

These and other features and advantages of the invention will become apparent upon further reading of the specification in light of the accompanying drawings.

BRIEF DESCRIPTION OF THE DRAWINGS

FIG. 2B is a sectioned top plan view of the vent assembly of FIG. 1 installed in the vent opening, with the wall or sill plate above the vent opening omitted for clarity.

FIG. 3 is a front elevation view of the vent assembly, similar to FIG. 2A but with an alternate rear frame, also with portions of the screen cut away for clarity.

FIG. 5A is an exploded rear perspective view of the front frame, tension member, and rear frame connections of the vent assembly in FIG. 5.

FIG. 6 is a front perspective view of the front frame of FIG. 5 pre-installed in the wall, and the rear frame collapsed and being inserted through the front frame and opening from outside the building.

FIG. 7 illustrates the manner of assembling the receiver panel of FIG. 5 to the installed front frame.

FIG. 8 is a rear perspective view of the vent assembly of FIG. 5 fully assembled and installed under tension in the vent opening.

DETAILED DESCRIPTION OF THE INVENTION

Figure 1:
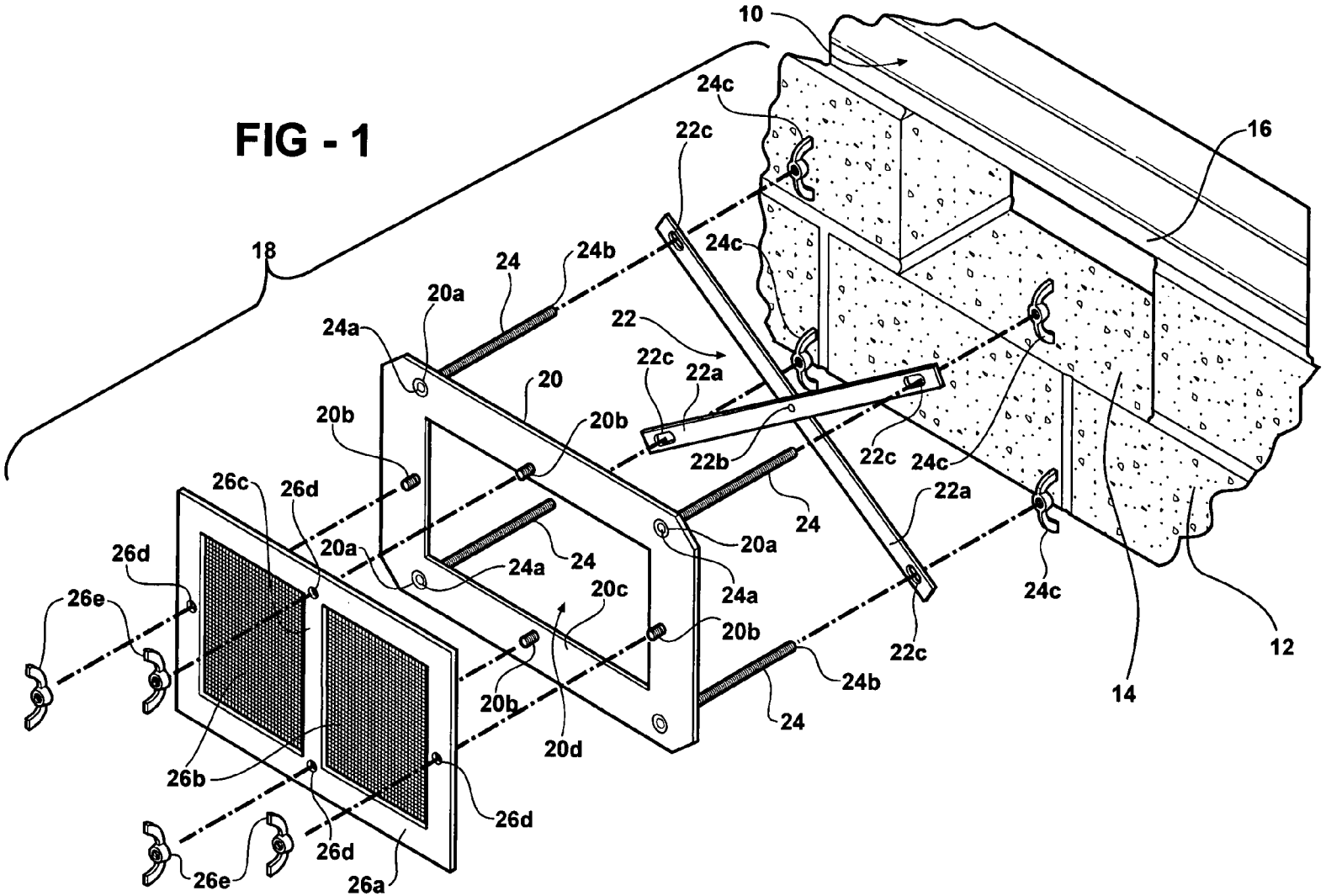
FIG. 1 is a perspective view of a portion of a building's foundation wall defining a crawl space, a vent opening in the wall from which an original, cemented-in vent has been removed, and a crawl space vent assembly according to a first retrofit embodiment of the present invention in an exploded relationship to the vent opening.

Referring first to FIG. 1, part of a building 10 is shown with a common type of foundation wall 12, for example poured concrete or concrete block, and one or more crawl space vent openings 14 formed in the wall at the time of construction. If a block wall, vent opening 14 is often formed by simply leaving a block out of the wall between sill plate 16 and the ground, and accordingly has the same dimensions as a block. Each wall of the foundation will usually have at least one crawl space vent opening 14. It will be understood that although the term "crawl space" is used herein for convenience (and as the most common type of installation and the one for which the vent assembly is preferentially designed), there may be similar spaces in building foundations and walls where passive venting is required, such as warehouses, silos, bunkers, and others where the inventive vent assembly will be useful.

Illustrated vent opening 14 is part of a finished wall, originally provided with a vent of known type (not shown) including a screen, mesh, and/or grille to keep insects and/or rodents out of the crawl space. Such crawl space vents are installed at the time of construction, and are often cemented in place in essentially permanent fashion. They can be removed by breaking them out of their openings 14 with tools, usually by chiseling and prying.

FIG. 1 illustrates a first embodiment 18 of a crawl space vent assembly according to the present invention, prior to being installed in vent opening 14 after the original vent has been removed. Vent 18 has a front frame or face plate 20, a rear frame 22 connected to front frame 20 with tension members 24, and a cover or venting plate 26 removably secured to front frame 20. In the illustrated embodiment, the foregoing portions of vent 18 are made from weather-resistant metal such as aluminum and/or stainless steel, but they can also be made from various plastics instead of or in combination with metal. For example, frame 20 can be a suitable plastic colored to match the foundation wall 12 and/or the building 10, while venting plate 26 can have an outer frame portion 26*a* of similarly colored plastic and screen portion 26*b* of metal. The term "plate" is used herein to generally describe venting cover 26, but should be considered to include any generally plate- or panel-like structure following the general contour of the wall and need not be perfectly flat.

Front frame 20 in the illustrated embodiment is a rectangle sized to fit around a typical rectangular, block-sized vent opening such as opening 14, with holes or receivers 20*a* for connecting tension members 24 and attachment points 20*b* for removably securing venting plate 26. Illustrated points 20*b* are short threaded studs for receiving nut members such as wing-nuts, although it will be understood that other known fastening arrangements, for use with or without tools, can be used to secure the tension members to the frame. The inner periphery portion 20*c* of frame 20 overlies the front of opening 14, preferably no more than necessary to permit tension members 24 to be securely connected to the frame and extend through the opening in order to maximize the available venting area 20*d* through frame 20. The remainder of frame 20 engages the outside surface of wall 12 around opening 14.

Rear frame 22 in FIG. 1 is an X-shaped structure comprising two essentially flat members 22*a* of metal or plastic, pivotally connected at 22*b* to be folded together for insertion through the front of opening 14. When opened, frame 22 spans opening 14 such that the ends of members 22*a* engage the inside surface of wall 12 around the rear of opening 14 in the crawl space. Slots 22*c* are formed near the ends of members 22*a* to receive the ends of tension members 24, the slots having sufficient length to facilitate the alignment and insertion of the tension member ends individually into their respective slots. It will be understood that although flat rear frame members are preferred, other configurations are possible.

Illustrated tension members 24 are threaded rods or bolts with heads or receiver ends 24*a* engaging front frame 20 at openings/receivers 20*a*. Each tension member 24 has a length greater than the depth of opening 14 so that enough free end 24*b* protrudes (FIG. 2) from the rear of vent opening 14 and the back of frame 22 to receive a nut or fastener such as wing-nut 24*c*. It will be understood that other forms of tensionable connectors could be used in place of threaded rods or bolts, but that these are the preferred example. And while several connectors are shown in the illustrated embodiment, it is possible although less desirable to use a single connector.

While some length adjustment will be inherent in most tensionable connectors, the connectors can be made sufficiently long to accommodate the thickest possible wall expected to be encountered. For example, members 24 may be sized to accommodate twelve-inch as well thick block wall, and accordingly can also be installed on walls formed with smaller blocks. In this manner the inventory needed on hand by an installer can be reduced.

As noted above, venting plate 26 has an outer frame portion 26*a*, and an inner screen or mesh portion 26*b*. Outer frame portion 26*a* is sized to overlie the inner periphery 20*c* of front frame 20, while screen portion 26*b* preferably has an area corresponding to the opening 20*d* in front frame 20 for maximum venting. While 26*b* is referred to as a "screen" for convenience, it will be understood that it can be a grille, screen, mesh, hardware cloth or similar material or combination thereof sufficiently strong and sufficiently subdivided to keep out various pests. In the illustrated embodiment, screen 26*b* is made from a strong, fairly rigid, stainless steel mesh. Depending on the rigidity of the material in screen 26*b* and the anticipated pests, optional interior bracing such as 26*c* can be added to frame 26*a* to protect and support the screen.

Screen portion 26*b* can be permanently secured to the venting plate 26, or removably secured for cleaning or to replace a damaged screen without having to replace the entire venting plate.

Outer frame portion 26*a* includes holes 26*d* that accept attachment studs 20*b* to align and support plate 26 when the venting plate is placed over front frame 20. Fasteners such as wing-nuts 26*e* can be used to removably secure plate 26 to the front frame, allowing the venting plate to be quickly and easily installed without tools.

Figure 2:
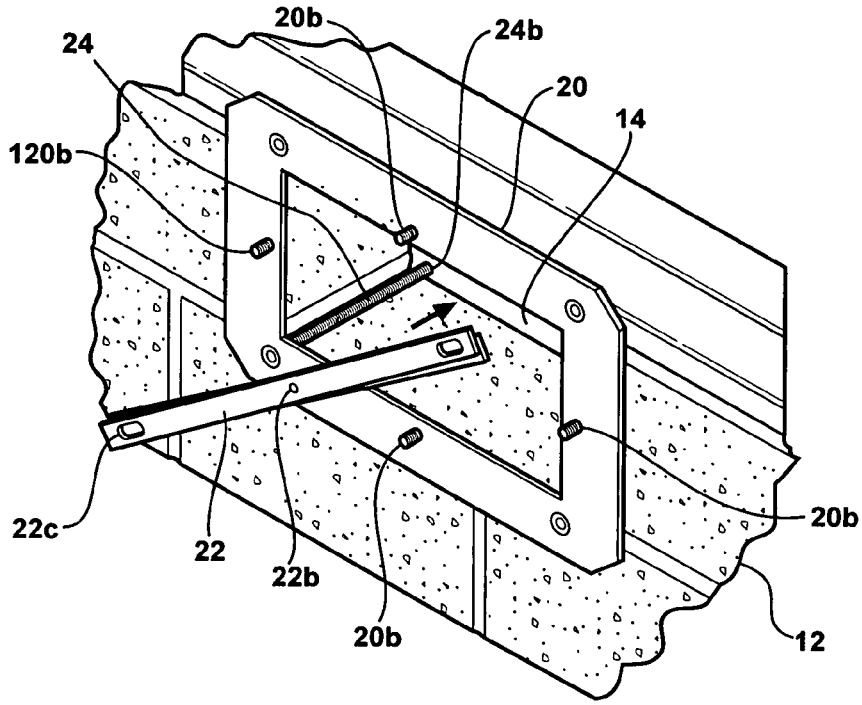
FIG. 2 is a perspective view of the vent assembly of FIG. 1, with the rear frame of the crawl space vent folded and inserted through the vent opening after the front frame has been positioned in the opening.

FIG. 2 shows front frame member 20 installed on wall 12 around opening 14, with tension members 24 extending through the opening from the frame. Front frame 20 is sealed at wall 12 by a peripheral seal material or gasket 20*e* on the rear face of the frame, for example a bead of flexible, weatherproof silicone sealant that forms a good seal with the wall when frame 20 is tensioned against the wall. Rear frame 22 is shown folded and being inserted through front frame 20 and opening 14 from outside the building. After axially inserting the front frame and tension member assembly in vent opening 14, the installer simply puts the folded rear frame through the front frame and vent opening by hand.

Figure 2A:
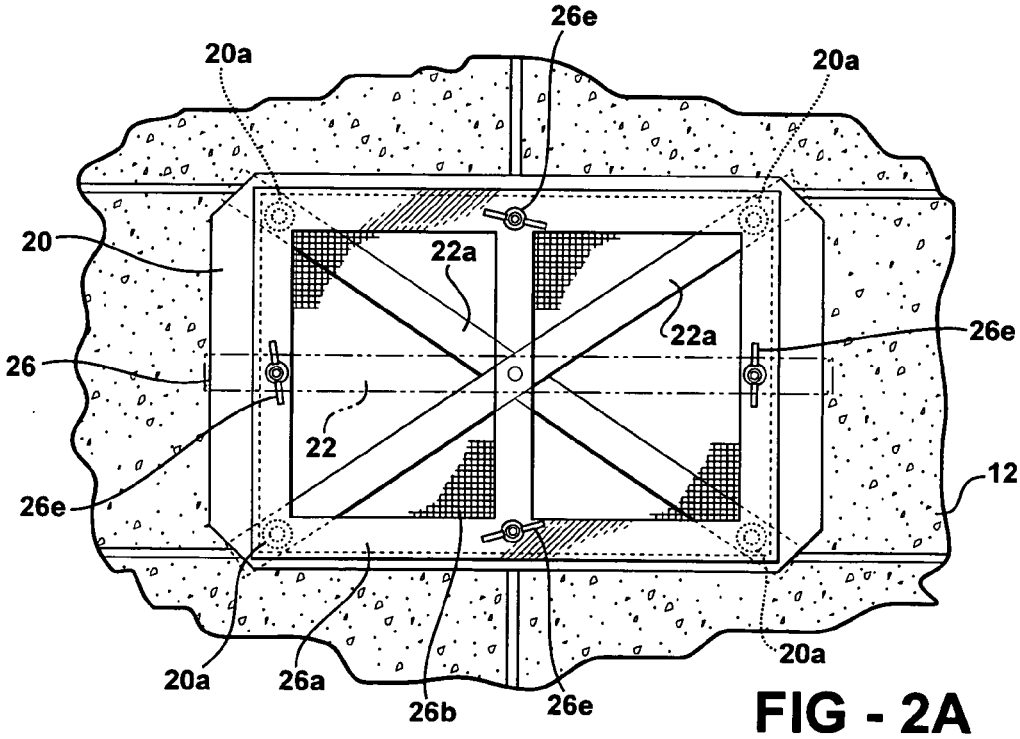
FIG. 2A is a front elevation view of the vent assembly of FIG. 1 installed in the vent opening, with the rear frame shown in both folded (phantom lines) and opened (solid lines) positions and with portions of the screen mesh cut away for clarity.

FIG. 2A shows the retainer in both folded (phantom) and unfolded (solid) conditions at the rear of the opening. By way of example, folded frame 22 can be inserted through frame 20 and opening 14 from outside by the installer, opened up into the illustrated X configuration inside the crawl space and held with one hand in the center, and engaged with the free ends 24*b* of tension members 24 by placing slots 22*c* over ends 24*b*. Wing-nuts 24*c* can then be threaded onto ends 24*b* with the other hand. Tightening wing-nuts 24*c* draws rear frame 22 against the inside surface of wall 12 around the opening, securing the vent assembly in the opening under tension.

FIG. 2B is a plan view of vent 18 installed in opening 14, clearly showing the tensioned engagement of rear frame 22 against the rear surface 12*b* of wall 12, and the manner in which frame 22 is fastened to members 24. Front frame 20, rear frame 22, and opening 14 define a box-shaped volume capable of receiving a quantity of insulation. It will be understood that this volume need not literally be rectangular, but "box" is used as a convenient term to describe the volume so enclosed.

FIG. 3 shows an alternate rear frame 22', in the shape of a flat, non-foldable skeletal frame that can be inserted endwise into opening 14, reoriented once inside the crawl space, and assembled to tension members 24 in the manner described above. It will be understood that other configurations for the frame are possible, both folding and non-folding, while still minimizing obstruction to airflow and allowing the installer's hand to reach through the rear frame form outside the building to connect and operate tension members 24.

Figure 4:
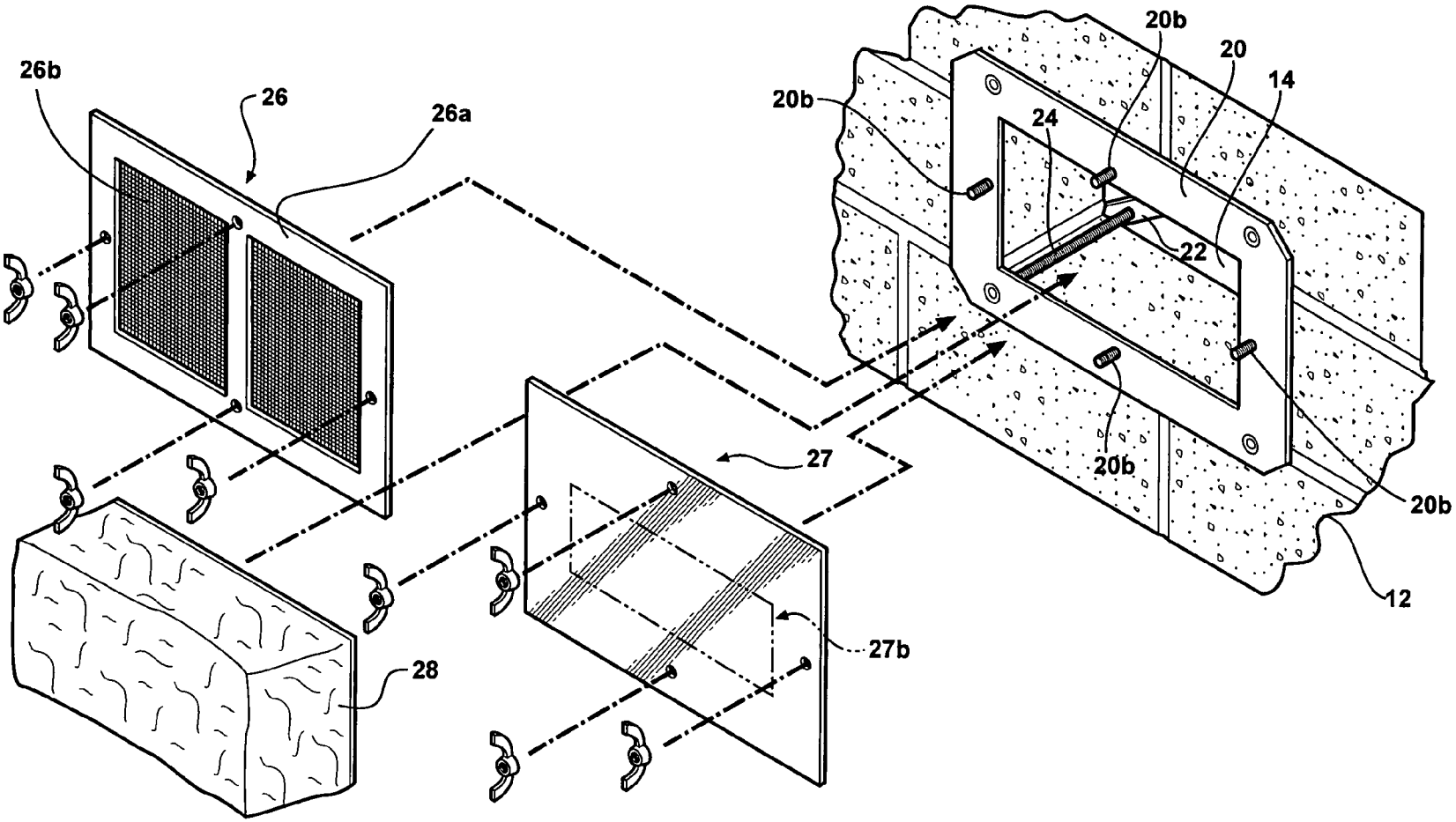
FIG. 4 is a perspective view of the installed vent assembly of FIG. 1 from the outside of the building, with open and restricted venting plates and an optional, removable insulation package shown in exploded relationship to the front frame of the vent.

FIG. 4 shows a winter or reduced-venting cover plate 27 that replaces screened cover plate 26 when heat loss becomes a greater concern than venting. Reduced venting plate 27 is a solid plate of metal or plastic, with a smooth, flush fit to front frame 20, or an optional peripheral seal or gasket (not shown), for a tight fit against front frame 20. Venting plate 27 can include one or more reduced-area, screened openings such as 27*b* shown in phantom so that some venting still takes place.

FIG. 4 also shows an example of optional insulation in the form of a volume of standard fiberglass batt insulation 28, sized to fit snugly in and fill the volume of opening 14 between front frame 20 and rear frame 22. Other known types of insulation can be used, provided they generally fill the volume of opening 14 when inserted; foam blocks are one possible example. The insulation may be loose and breathable, or partly or fully enclosed with a smooth, weather-resistant cover.

Figure 5:
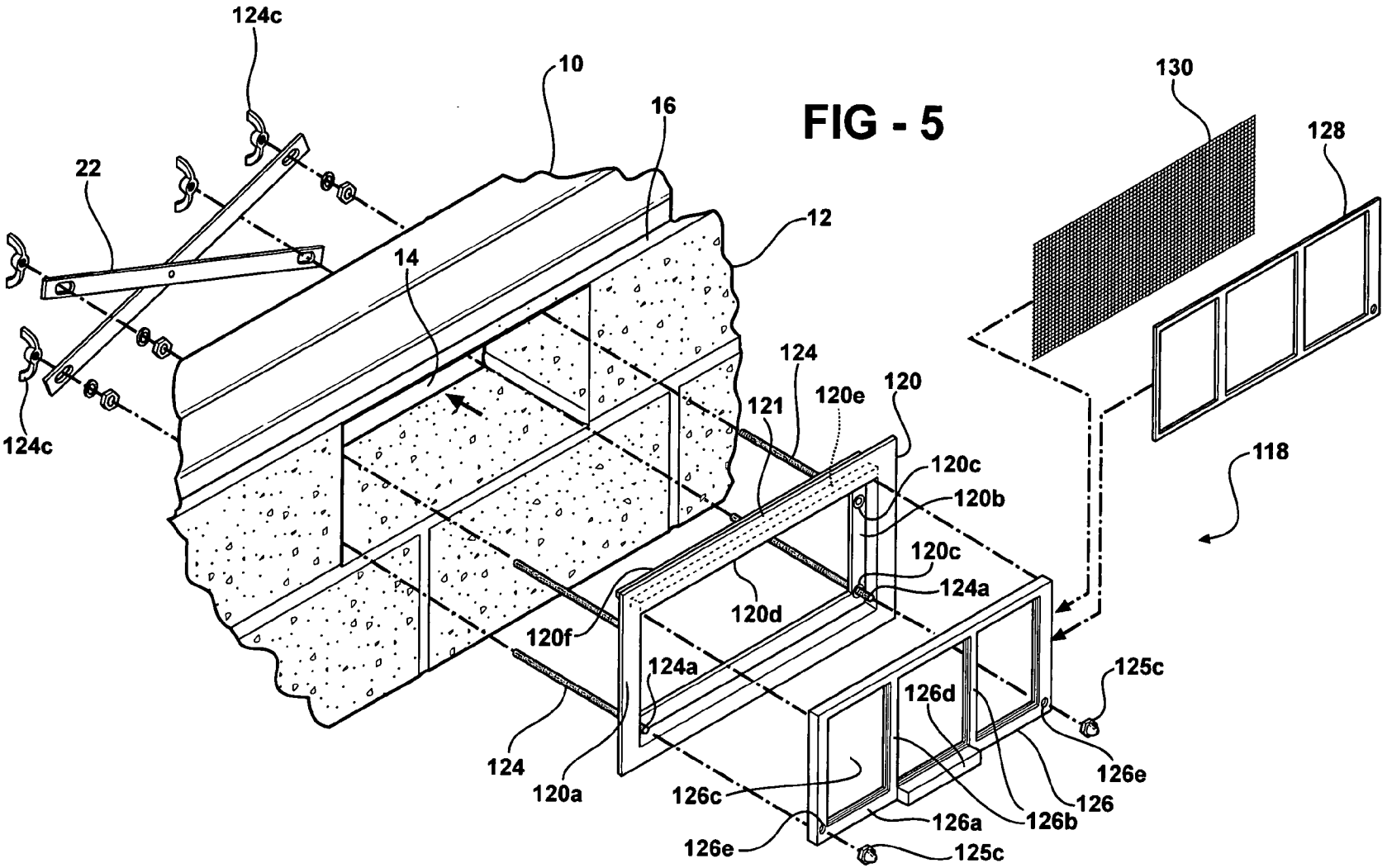
FIG. 5 is an exploded front perspective view of a most preferred retrofittable vent assembly according to the invention.

Referring next to FIGS. 5 through 13, a more preferred embodiment of a retrofittable vent assembly is generally denoted at 118 in FIG. 5. Vent assembly 118 includes a front frame 120, the rear frame 22 of the previous embodiment, tension members 124 connected to the front frame and adapted to extend through vent opening 14 in wall 12, a receiver panel 126 removably installed on the outer side of front frame 120, a venting plate 128, and a screen 130. As noted above for the previous embodiment, the foregoing can be made from metals, plastics, or combinations thereof as will be apparent to those skilled in the art. In the illustrated embodiment of FIG. 5, tension members 124 and their associated connectors and fasteners and screen 130 are preferably made of metal such as stainless steel or aluminum, while the other components of vent assembly 118 are made from suitable plastics. The portions of vent assembly 118 visible from the outside of building 10 may be colored and/or textured to match the color and/or texture of wall 12 or of building siding 10.

Like vent assembly 18 in FIGS. 1 through 4, vent assembly 118 is designed to be axially assembled to a vent opening 14 in a finished wall, from the outside of the building, usually after removing the original vent from the opening. As best shown in FIG. 6, front frame 120 with its connected tension members 124 is first installed in opening 14, loosely held in place by the configuration of the tension members conforming to the dimensions of the opening, and optionally further secured in a manner described below to the typical sill plate 16 found in residential construction. Since vent openings 14 are typically of standard sizing, front frame 120 and the tension members (like those in vent assembly 18 above) are preferably manufactured with corresponding dimensions for an initially self-supporting fit in the opening. Since the front frame must form a good seal around opening 14, the rear faces of its wall-engaging surfaces can be dimensioned for a flush fit with the outer face of the wall and/or sealed with a preformed gasket or sealing material of known type.

Referring particularly to FIGS. 5 and SA, tension members 124 (threaded rods or bolts similar to 24 above) are connected at one end to the rear face of recessed frame portion 120*b* by threading them into or through holes 120*c* that are either internally threaded or supplied with threaded receiver 125. The lower pair of tension members 124 is preferably longer than the upper pair, and additionally provided with retaining nuts 125*a*, so that their front ends 124*a* protrude from the front of recessed frame portion 120*b* as shown in FIG. 5. The front ends of the upper pair of tension members preferably stop flush with or to the rear of the front surface of recessed frame portion 120*b* as shown in FIG. 5. Once thus connected to front frame 20, the inner or "free" ends 124*b* of the tension members are positioned to receive the slotted ends of rear frame 22, preferably with intervening retaining nuts 125*a* and retaining washers 125*b* for adjusting the position and tension of rear frame 22 relative to front frame 120 on the tension member array. Rear frame 22 is then secured to the tension members with wing nuts or similar fasteners 124*c*. Retaining nuts 125*a* are preferably pre-positioned to the depth dimensions of opening 14, although they can be adjusted on the spot by the installer from the outside simply by reaching through the open front frame and threading them forward or backward on the tension members.

FIG. 6 shows front frame 120 pre-installed in opening 14, and rear frame 22 being handed through in its folded or collapsed state. Once the rear frame is opened up and connected to front frame 120 through tension members 124, tension adjusting wingnuts 124*c* are rotated by the installer (reaching through the opening and front frame from outside the building) until the front and rear frames are securely tensioned against the outside and inside faces 12*a* and 12*b* of wall 12 (FIG. 8).

FIG. 7 shows receiver 126 being installed on front frame 120, by inserting its upper edge upwardly at an angle underneath the edge of the upper frame portion 121 into a mating channel 120*e* formed between the extended lower edge 121*a* of upper frame portion 121 and recessed frame portion 120*b*. In the illustrated embodiment, the front side of the up per edge of receiver panel 126 is provided with an interlock portion 126*h* (see especially FIG. 11A) that rotatably mates with a corresponding interlock groove 120*h* formed on the inside front edge of channel 120*e* to allow an initial angled insertion of the receiver panel into channel 120*e* until the interlock portions are mated, and a subsequent rotation of the lower edge of the receiver panel 126 into axial engagement with the front frame 120. Once the upper part of receiver 126 is located in channel 120*e* and rotated inwardly it becomes locked so that it cannot fall or inadvertently be pulled out of the vertical channel 120*e*. The lower part of receiver 126 is rotated into recessed portion 120*b* with the protruding ends 124*a* of the tension members going through receiver holes 126*e*. The receiver at this point will remain in the front frame on its own, for hands-free installation of receiver fasteners such as acorn nuts 125*c* (FIG. 5), which are then tightened over ends 124*a*, securely fastening receiver 126 in front frame 120. The receiver 126 is recessed for a flush, weather-resistant fit and attractive appearance.

Figures 11, 11A:
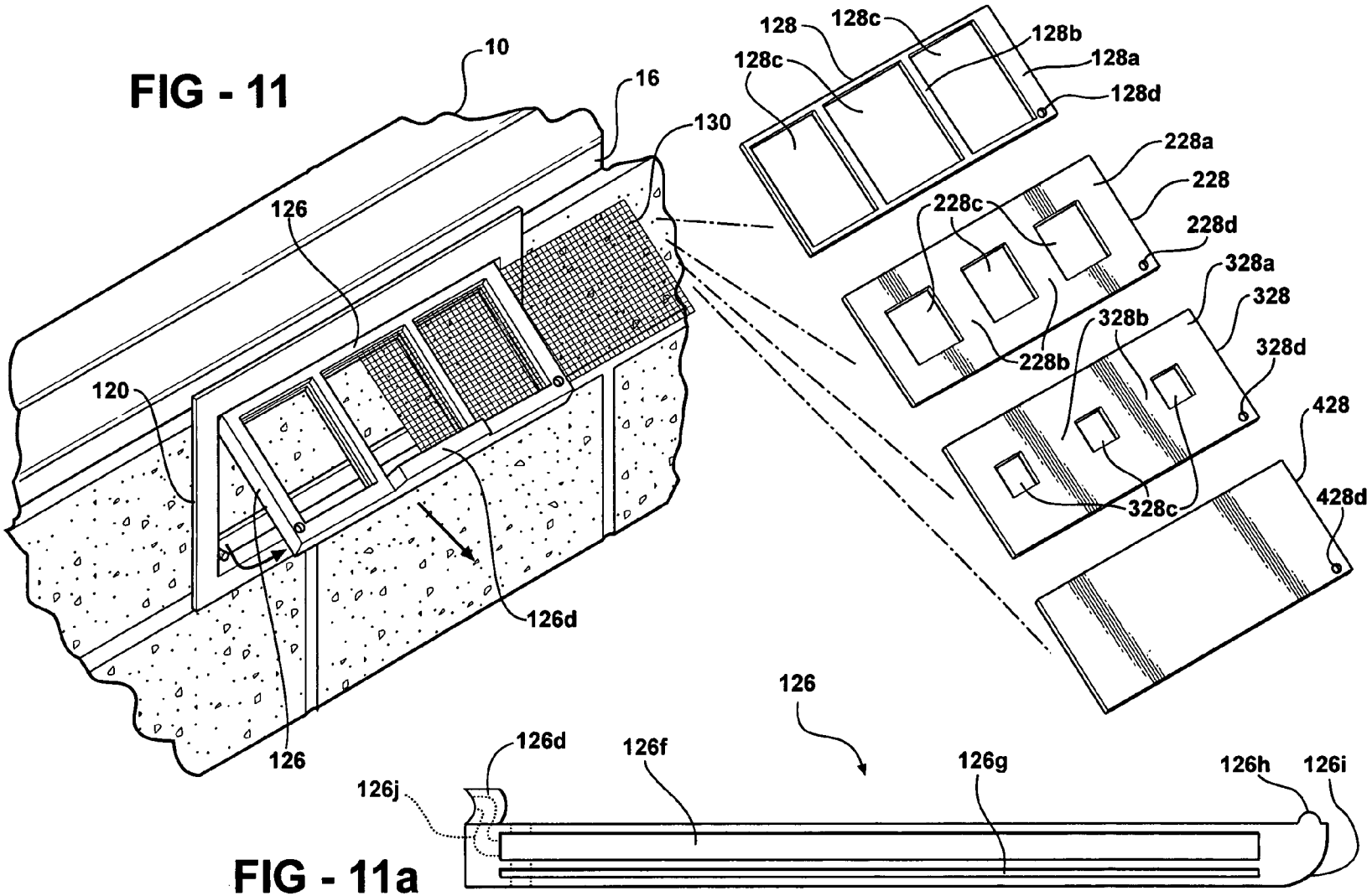
FIG. 11 is a perspective front view of the installed vent assembly of FIG. 5, with the receiver panel being removed for replacement of screen and venting plate members.
FIG. 11*a* is a right side elevation view of the receiver panel of FIG. 5, showing screen and vent plate slots.

FIG. 11A shows more detail of the interlock portion 126*h* on receiver 126, in the illustrated embodiment a rounded bead extending lengthwise along the upper front edge of receiver 126. Rotation of the receiver from the initial inserted position to the initial interlock with channel 120*e* and further to the final assembled position flush with the face of frame 120 is assisted by a rounded back edge 126*i* behind interlock portion 126*h*.

Removing receiver 126 is done by removing nuts 125*c*, tilting the lower edge of the receiver outwardly while the upper edge remains rotatably interlocked with the front frame until bead 126*h* disengages from interlock groove 120*h* in channel 120*e*, and then pulling receiver 126 out of the channel at an angle as shown by the straight arrow in FIG. 11.

As shown in FIG. 5, venting plate 128 and screen 130 are inserted independently into slots in the side of receiver 126 before the side of the receiver is recessed into front frame 120. Although receiver 126 preferably includes crossmembers or similar reinforcing portions 126*b* to support and protect the screen insert, the screen is preferably located behind the venting plate as shown for added protection. As can be seen in FIG. 5, and even better in FIG. 11A, receiver 126 has a rigid outer frame 126*a* sized to fit neatly against recessed portion 120*b* of front frame 120, one or more reinforcing members 126*b* subdividing the venting area 126*c* inside the outer frame, a handle 126*d* enabling an installer or repairman to rotate/lift the bottom of the receiver out of the front frame after nuts 125*c* are removed, front frame attachment points 126*e* on the lower part of the receiver, and slots 126*f* and 126*g* formed in one side edge of the receiver, sized to slidingly accept correspondingly sized venting plates and screen members.

FIG. 11A illustrates a drain structure 126*j* associated with the front slot 126*f* (where rain is most likely to collect between the venting plate and the receiver), the drain preferably funneling water out through the front of the receiver underneath or behind handle 126*d*. Slot 126*f* may contain multiple drain openings in its bottom surface, feeding into one or more drain channels such as 126*j* along the bottom edge of the receiver panel.

While receiver 120 is preferably made from a reasonably rigid plastic or metal, the inserted venting plate and screen member are preferably sized for a close fit with the interior dimensions of the slots to reinforce the receiver as a whole.

FIG. 8 illustrates the fully assembled vent 118 from the crawl space side of foundation wall 12, including a sill plate attachment flange 120*f* extending rearwardly from upper edge 121 of the front frame a distance greater than recessed frame portion 120*b*. Holes are formed through flange 120*f* behind recessed portion 120*b* to allow nails, screws, or other fasteners to be driven into engagement with a sill plate that typically caps the upper side of vent openings 14 in residential home construction. Flange 120*f* is preferably level with the top of opening 14 so that it is near or against the sill plate. In this manner, the pre-installed fit of front frame 120 in the vent opening can be strengthened to further ensure hands-free stability while the rear frame is being attached and adjusted.

Figure 9:
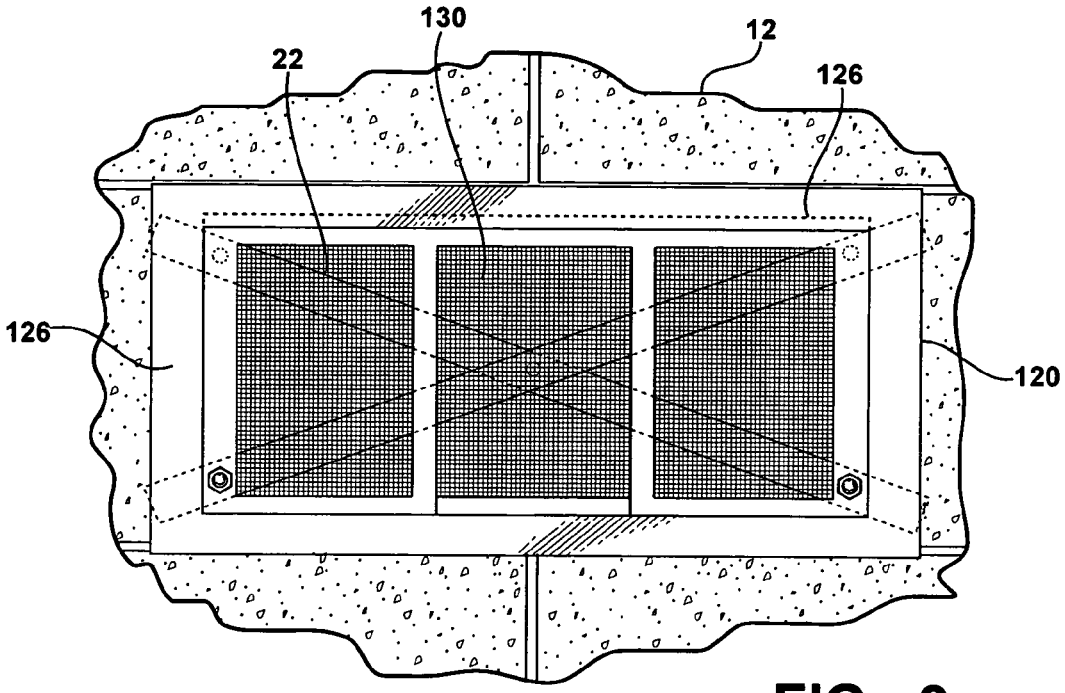
FIG. 9 is a front elevation view of the installed vent assembly of FIG. 5.

FIGS. 8 and 9 illustrate the large, uncluttered, screened area 126*a* available for airflow through the vent assembly. In these Figures, the venting plate 128 is the full-vent option, its surface area lying entirely within the borders of receiver 126 relative to area 126*a*, such that axial airflow through the screened portion of the vent assembly is unimpeded by anything other than screen 130 and any reinforcing members such as 126*b*. The surface area of any reinforcing members is accordingly preferably kept to a minimum.

Figure 10:
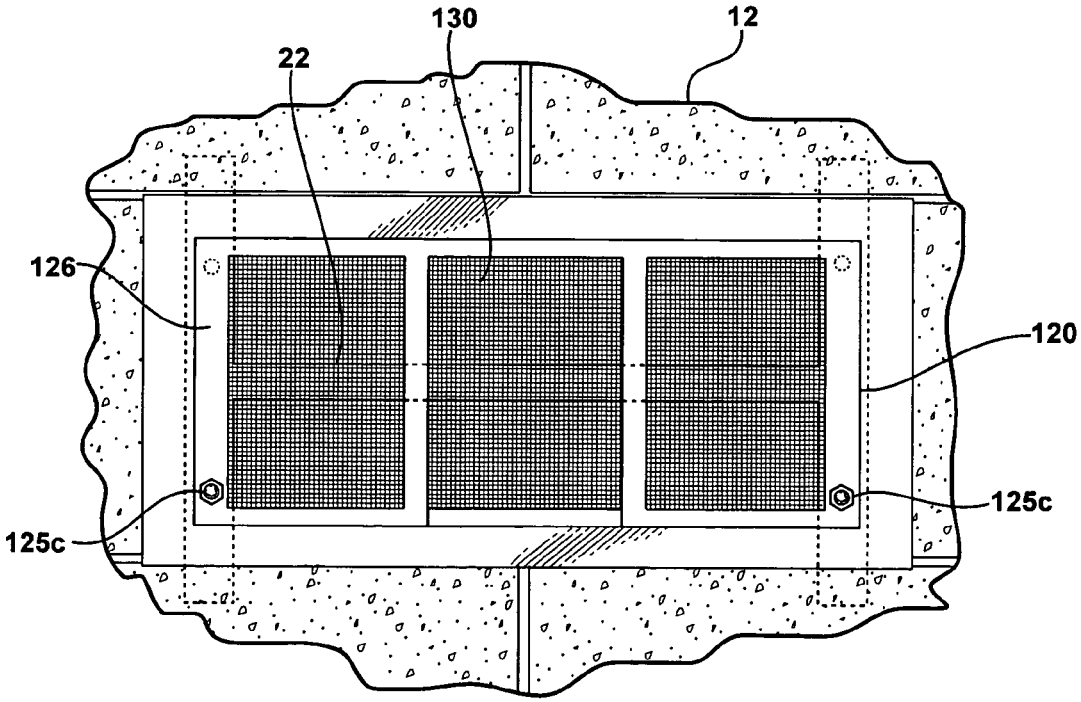
FIG. 10 is a front elevation view of the installed vent assembly of FIG. 5 with an alternate rear frame.

As shown in FIGS. 9 and 10, the surface area of rear frame 22 relative to axial airflow through the vent assembly is also preferably kept to a minimum, as mentioned above in reference to FIGS. 1 through 4. Although the collapsible X-version of FIG. 9 is currently the most preferred configuration for rear frame 22, it will be understood that other collapsible/foldable configurations are possible. Again, non-collapsible alternatives such as the I- or H-shaped rear frame 23 shown in FIG. 10 are also possible, sized to be inserted with one orientation and then reoriented to engage the inside face of wall 12 around opening 14.

Figure 12:
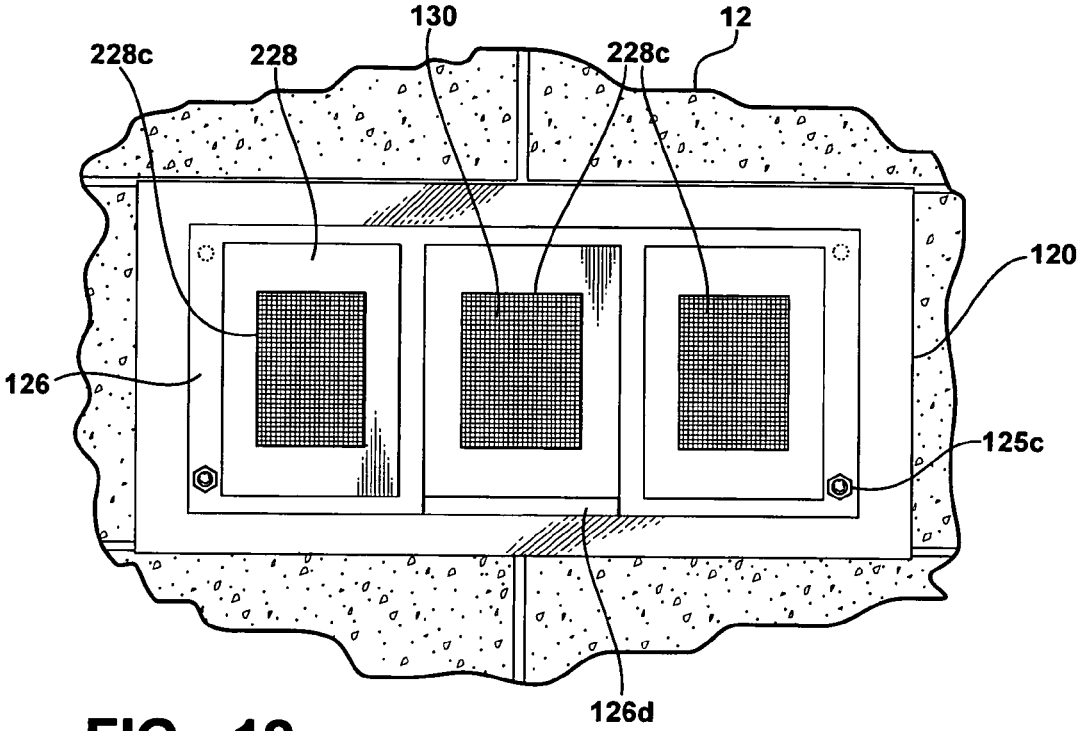
FIG. 12 is a front elevation view of the vent assembly of FIG. 5 with one of the alternate reduced venting plate options from FIG. 11 installed.
Figure 13:
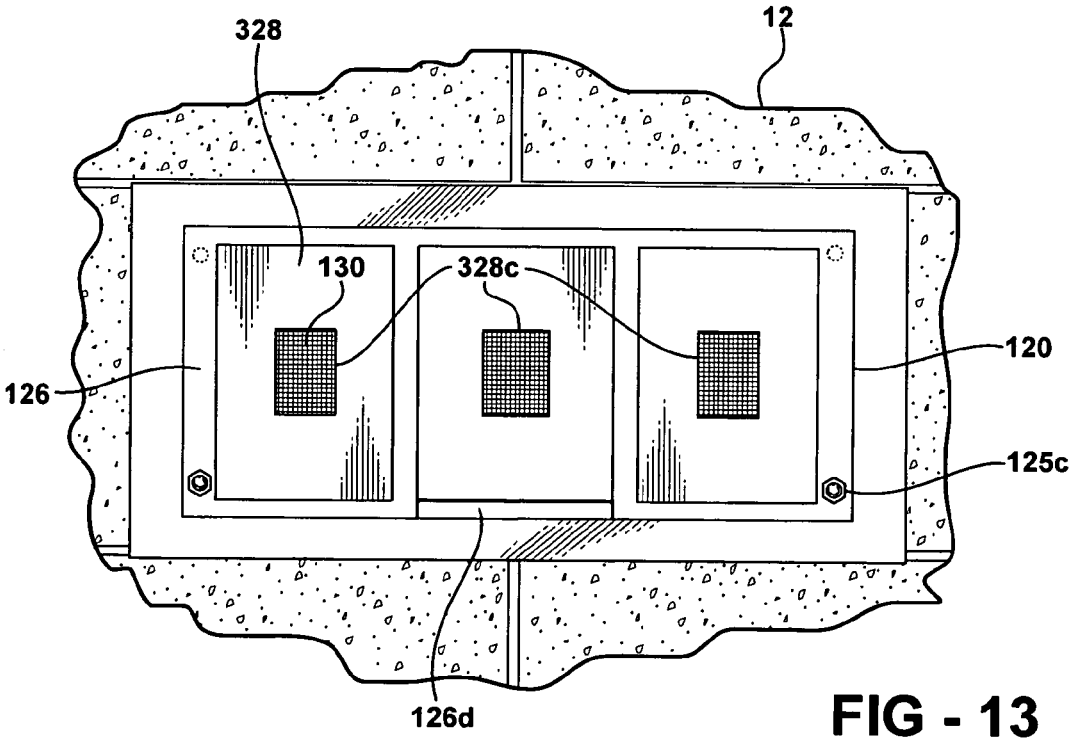
FIG. 13 is a front elevation view of the vent assembly of FIG. 5 with another of the swappable venting plate options from FIG. 11 installed.

FIGS. 11 through 13 show a preferred set of venting plate options supplied with vent 118. In addition to screen 130 and full-open venting plate 128, one or more restricted venting plates 228, 328, 428 is provided to seasonally reduce airflow and heat loss through the vent. The illustrated venting plates 128–328 represent a preferred embodiment, in which their outer frame portions 128*a*–328*a*, their inner or reinforcing frame portions 128*b*–328*b*, and their airflow openings 128*c*–328*c* are axially aligned with one another and with the screened airflow openings in receiver 126, all of which presents a symmetrical and aesthetically pleasing arrangement from the outside of the house, even where different venting plates are installed in different vent assemblies at the same time. It will be understood that screen 130 remains installed securely in receiver 126 while the venting plates are replaced, and preferably remains in the receiver no matter the season or which of the venting plates is installed.

Reduced venting plate 428 is actually a full-closed option, and is preferably only used where the disadvantages of heat loss in a particular vent outweigh the disadvantages in closing the vent entirely, a determination preferably made by a skilled person such as a building inspector or contractor. If plate 428 is used, it may also be desirable to insert insulation in the "box" defined by the front and rear frames as described above for FIGS. 1–4. Depending on the venting needs and the porosity/breathability of the insulation used, it may also be useful in some circumstances to insert insulation behind one of the other venting plates for a combination of venting and insulation, and possibly even an air-filtering effect.

It will be understood from FIGS. 5 through 13 that vent assembly 118 is robust, damage-resistant, easy to install from outside the building, and particularly easy to adjust or repair via the easily-removed receiver and side-inserted screen and venting plates. If the screen, the venting plate, or even the receiver is damaged, it is easily removed and replaced from outside the house with hand tools or no tools. It is also attractive in any of its venting configurations.

Figure 14:
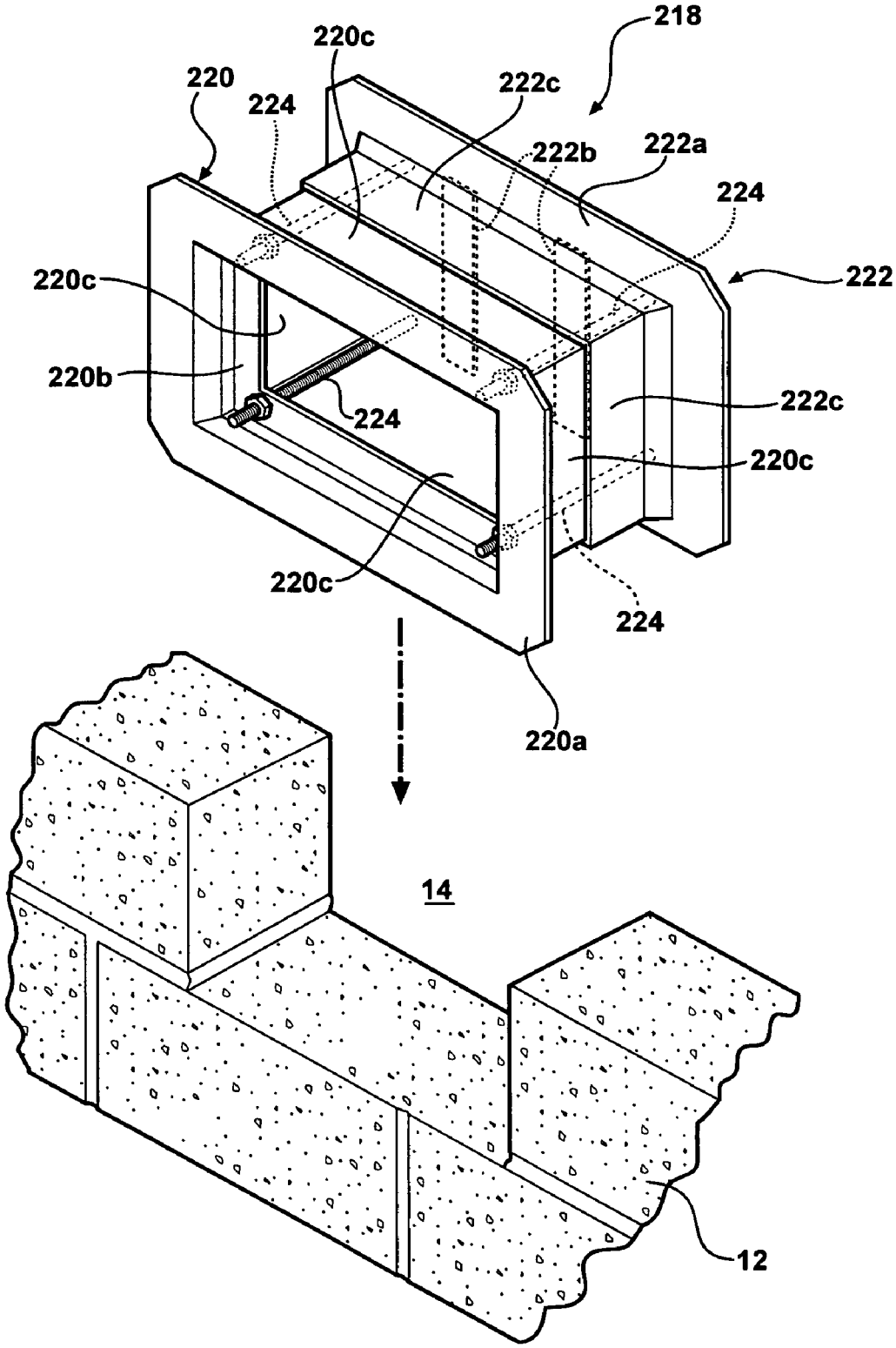
FIG. 14 is a perspective view of a second, drop-in embodiment of a crawl space vent assembly according to the invention, positioned above a vent opening in the foundation wall for installation as the wall is being built.
Figure 15:
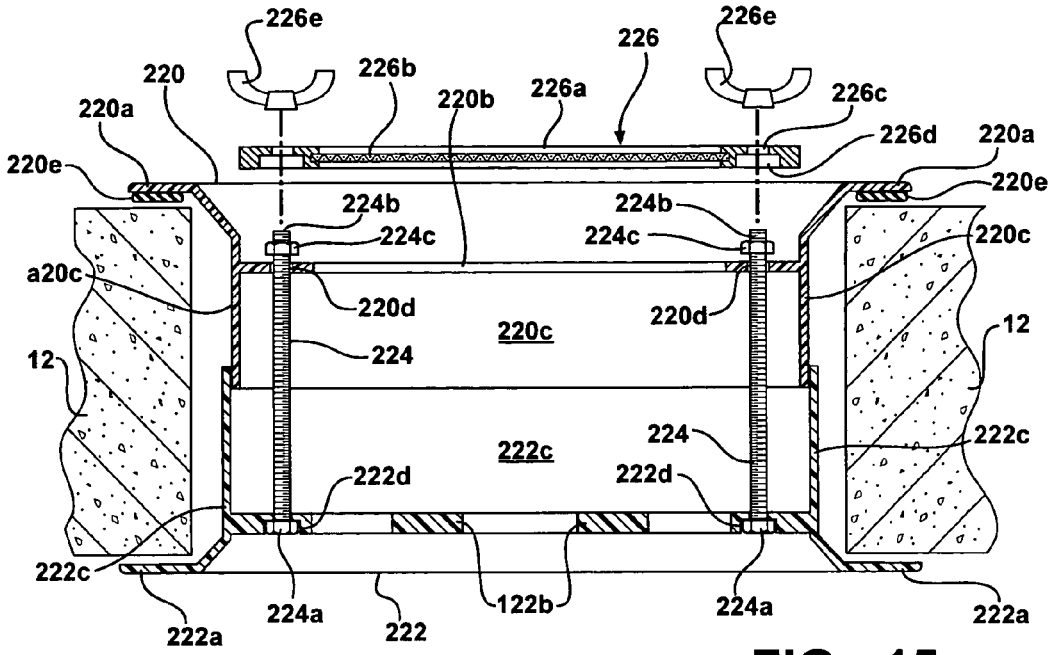
FIG. 15 is a sectioned top plan view of the vent assembly of FIG. 14 installed in the vent opening in an expanded state, and with the venting plate exploded away from the front frame.
Figure 15A:
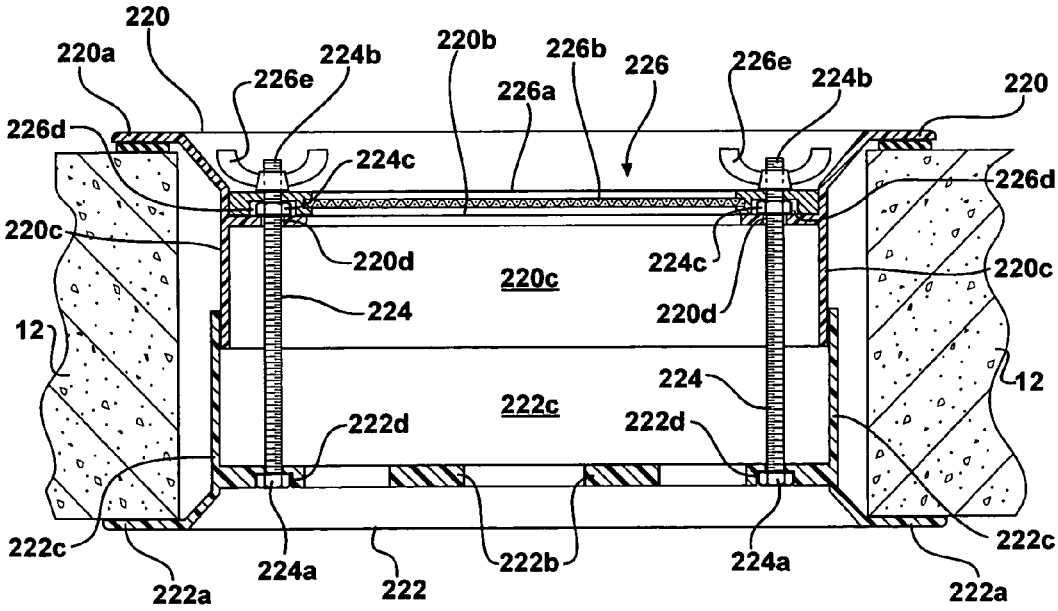
FIG. 15A is similar to FIG. 15, but showing the vent telescoped into tensioned engagement with the inner and outer wall surfaces around the vent opening, and showing the venting plate installed.

FIGS. 14, 15 and 15A illustrate a crawl space vent 218 designed for installation in vent opening 14 at the time of construction, before the top of the opening has been covered with a sill plate or another course of block. Vent 218 is installed in vertical, drop-in fashion as shown by the arrow. Vent 218 has a front frame 220 with a wide flange or faceplate portion 220*a* for engaging the outside face of wall 12, and a recessed flange 220*b* for mounting a cover plate. Rear frame 222 is similar, with a flange 222*a* for engaging the inside face of wall 12 in the crawl space, and one or more recessed insulation retainer portions 222*b*. Rear frame 222 is axially connected to front frame 220 in length-adjustable, tensionable fashion with tension members 224, in the illustrated embodiment four threaded rods or bolts with head ends 224*a* non-rotatably secured in recesses 224*d* in an interior wall portion of the rear frame, and with free ends 224*b* protruding through holes 220*d* in recessed flange 220*b* in the front frame. The tension members and their connections to the front and rear frames are surrounded by telescoping, boxlike enclosure portions 220*c* and 222*c* that extend from the front and rear frames and overlap in sliding fashion, with the rear enclosure portion 222*c* being larger to slide over front enclosure portion 220*c*.

As shown in FIG. 15, vent 218 is dropped into opening 14 with front and rear frames 220 and 222 spread wider than the wall thickness. The joined, boxlike body portions 220*c*, 222*c* make vent 218 sufficiently rigid to keep its shape during transport and after being placed in opening 14, so that no special positioning is required while tension members 224 are tightened with nuts 224*c* from the outside to draw the front and rear frames together against the outer and inner faces of wall 12, as shown in FIG. 15A. Free ends 224*b* remain exposed after vent 218 has been tensioned against the wall to receive cover plate 226 via mounting holes 226*c*, essentially the same as cover plate 26 described above with a frame portion 226*a* and a screen portion 226*b* but with mounting holes 226*c* having inner recesses 226*d* adapted to fit over tension nuts 224*c*. Wing-nuts 226*e* are finally applied to free ends 224*b* of tension members 224 to secure cover plate 226 against recessed front flange 220*b*.

Like vents 18 and 118 above, the adjustable length of vent 218 can be sized to accommodate the greatest wall thickness expected to be encountered, and will telescope to fit thinner wall, as well. The form and number of tension members can vary, and given the rigidity provided by box walls 220*c*, might even be flexible or elastic members.

It will be understood that screened cover plate 226 can be replaced with a reduced venting plate (not shown) similar to those described above in colder weather, secured in the same way with wing-nuts 226*e*.

Figure 16:
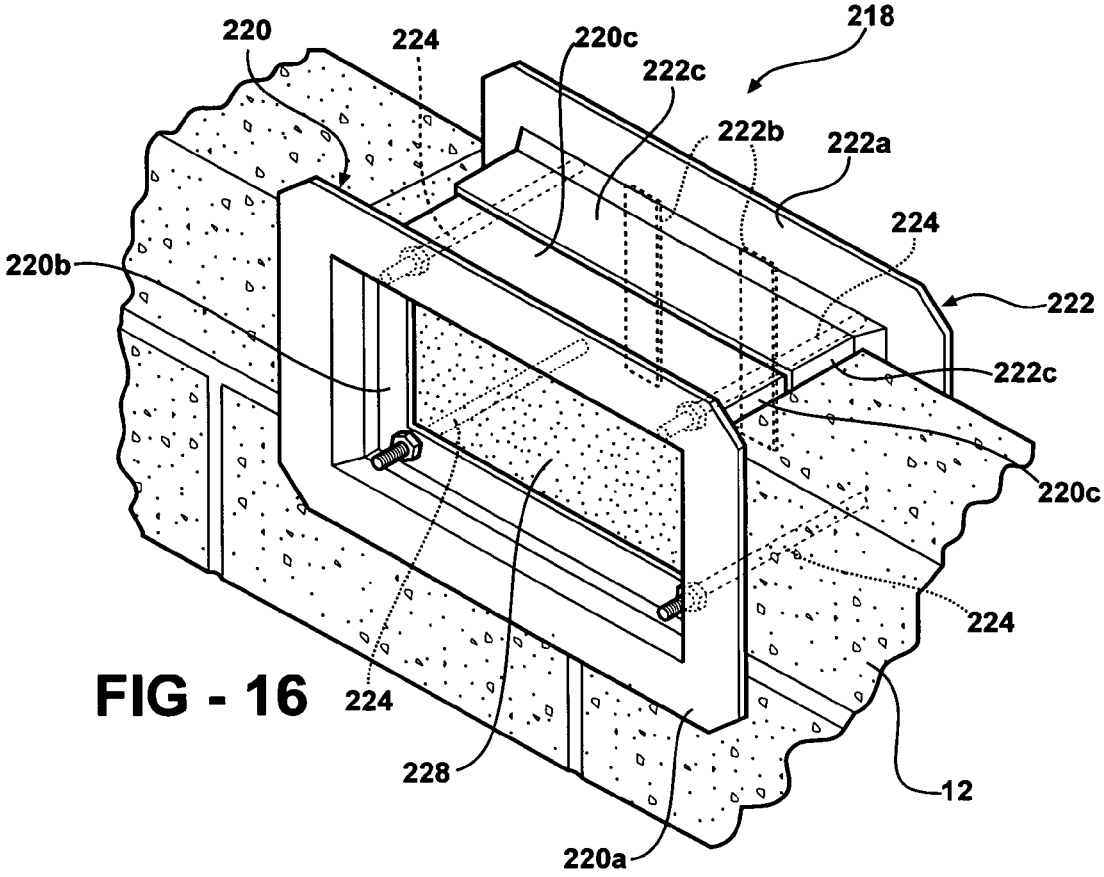
FIG. 16 is a perspective view similar to FIG. 14, but with the vent installed in the wall opening, and with optional insulation installed in the vent.

As best shown in FIG. 16, vent 218 is capable of accepting a block or mass of insulation 228 through front frame 220 from the outside of the house, similar to vent 18 described above. The rear insulation retainer 222*b* and the venting plate keep the contents in place.

It will be understood that the foregoing examples are presented for purpose of explanation rather than limitation, and that those skilled in the art will now be enabled to practice the invention that I have disclosed by way of these examples, often with modifications and adaptations using known equivalents, without departing from the scope of the invention as defined in the following claims.

I accordingly claim:

1. A vent for crawl space type vent opening in the wall of a building, comprising:

a front frame for engaging an outside face of the wall around the vent opening;

a removable venting plate adapted to be removably secured to the front frame from outside the building;

a rear frame connectable to the front frame with one or more tension members adapted to extend through the opening, the one or more tension members when connected to the front and rear frames through the vent opening being operable by a person outside to tension the front and rear frames against the wall;

wherein the one or more tension members are connected to the front frame to extend through the vent opening, when the front frame engages the outside face of the wall around the vent opening, and wherein the rear frame is removably connected to the one or more tension members and sized for insertion through the front frame and the vent opening after the front frame is engaged with the outside face of the wall around the vent opening with the one or more tension members connected to the front frame extending through the vent opening, and wherein the rear frame comprises one or more cross-members spanning the vent opening and having ends for engaging the inside surface of the wall around the vent opening.

2. The vent of claim 1, wherein the rear frame is collapsible for insertion through the front frame and the vent opening.

3. The vent of claim 2, wherein the rear frame comprises two pivotally connected cross-members.

4. The vent of claim 3, wherein the cross-members open into an X-shaped configuration.

5. The vent of claim 1, wherein the one or more tension members comprise one or more threaded rods extending between the front and rear frames.

6. The vent of claim 5, wherein the one or more threaded rods comprise a plurality of threaded rods connected to the front frame in a peripheral array conforming to the periphery of the opening, each tension member connected to the rear frame near an end of one of the one or more cross-members.

7. The vent of claim 1, wherein the venting plate includes a screen, the screened venting plate being removably fastened directly to the front frame.

8. The vent of claim 1, wherein the one or more tension members are removably connected to the front frame.

9. A method for providing seasonally adjusted venting in a crawl space type vent opening in the wall of a building, comprising the steps of:

placing a front frame against an outside surface of the wall around the opening, the front frame having one or more tension members connected thereto and extending through the vent opening when the front frame is placed against the outside surface of the wall around the vent opening;

placing a rear frame through the front frame and the vent opening from the outside of the building when the front frame is against the outside surface of the wall around the vent opening, the rear frame comprising one or more cross-members spanning the vent opening and having ends for engaging the inside surface of the wall around the vent opening, and then removably connecting the rear frame to the one or more tension members at the rear of the opening from the outside of the building; and, tensioning the front and rear frames against the outside face and an inside face of the wall, respectively, around the front and rear of the opening with the one or more tension members.

10. The method of claim 9, wherein the rear frame is inserted through the front frame and the vent opening from the outside of the building, the rear frame is connected to the front frame from the outside of the building, and the front and rear frames are tensioned against the wall using the one or more tension members from the outside of the building.

* * * * *